US008181694B2

(12) United States Patent
Powers et al.

(10) Patent No.: US 8,181,694 B2
(45) Date of Patent: May 22, 2012

(54) COLLAR RIB FOR HEAT EXCHANGER HEADER TANKS

(75) Inventors: Michael V. Powers, Lakewood, NY (US); Scot Carapellatti, Olean, NY (US)

(73) Assignee: Valeo, Inc., Auburn Hills, MI (US)

( * ) Notice: Subject to any disclaimer, the term of this patent is extended or adjusted under 35 U.S.C. 154(b) by 568 days.

(21) Appl. No.: 11/013,163

(22) Filed: Dec. 15, 2004

(65) Prior Publication Data

US 2005/0133208 A1 Jun. 23, 2005

Related U.S. Application Data

(60) Provisional application No. 60/530,957, filed on Dec. 19, 2003.

(51) Int. Cl.
*F28D 1/00* (2006.01)
*F28F 9/02* (2006.01)
*B21D 51/38* (2006.01)

(52) U.S. Cl. ..... 165/149; 165/175; 29/890.052

(58) Field of Classification Search ..... 165/175, 165/149; 29/890.052
See application file for complete search history.

(56) References Cited

U.S. PATENT DOCUMENTS

| | | | | |
|---|---|---|---|---|
| 4,023,618 | A | 5/1977 | Kun et al. | |
| 4,183,402 | A | 1/1980 | Cotter | |
| 4,559,688 | A * | 12/1985 | Abu-Isa et al. | 29/890.052 |
| 4,722,387 | A * | 2/1988 | Aurand | 165/153 |
| 4,972,615 | A * | 11/1990 | Grant | 40/641 |
| 5,107,926 | A * | 4/1992 | Calleson | 165/173 |
| 5,195,581 | A * | 3/1993 | Puntambekar et al. | 165/173 |
| 5,201,368 | A * | 4/1993 | Kroetsch | 165/173 |
| 5,228,512 | A * | 7/1993 | Bretl et al. | 165/153 |
| 5,320,165 | A * | 6/1994 | Hughes | 165/153 |
| 5,758,721 | A * | 6/1998 | Letrange et al. | 165/173 |
| 5,873,409 | A * | 2/1999 | Letrange et al. | 165/173 |
| 5,894,649 | A * | 4/1999 | Lambert et al. | 29/890.052 |
| 5,899,267 | A * | 5/1999 | Kroetsch et al. | 165/173 |
| 5,947,196 | A * | 9/1999 | Halm et al. | 165/173 |
| 6,035,931 | A * | 3/2000 | Kado et al. | 165/174 |
| 6,179,049 | B1 | 1/2001 | Higgins | |
| 6,196,305 | B1 * | 3/2001 | Geiger | 165/149 |
| 6,749,015 | B2 * | 6/2004 | Moreau | 165/174 |
| 7,121,329 | B2 * | 10/2006 | Shields et al. | 165/149 |
| 7,234,511 | B1 * | 6/2007 | Lesage | 165/69 |
| 7,604,044 | B2 * | 10/2009 | Kawakubo et al. | 165/175 |
| 7,637,314 | B2 * | 12/2009 | Park et al. | 165/174 |
| 2003/0217838 | A1 | 11/2003 | Dey et al. | |
| 2006/0162917 | A1 * | 7/2006 | Park et al. | 165/175 |

FOREIGN PATENT DOCUMENTS

| | | | |
|---|---|---|---|
| FR | 2777645 | A1 * | 10/1999 |
| GB | 2166862 | A | 5/1986 |

OTHER PUBLICATIONS

English Abstract of FR2777645A1.*

* cited by examiner

*Primary Examiner* — Cheryl J Tyler
*Assistant Examiner* — Brandon M Rosati
(74) *Attorney, Agent, or Firm* — Dierker & Associates, P.C.

(57) ABSTRACT

The present disclosure relates to automotive heat exchangers, and, heat exchanger tanks with headers. The heat exchanger eliminates the need for use of an inner flange on the header using a collar that also acts as a rib, thereby providing a compact foot plus header tank arrangement with lower stress on the gasket mating surface of the header and tank. The present disclosure also provides a method for providing improved headering for automotive heat exchangers with plastic tanks and headers.

13 Claims, 8 Drawing Sheets

COLLAR RIB FOR HEAT EXCHANGER HEADER TANKS

This application claims priority of provisional application 60/530,957 filed Dec. 19, 2003.

FIELD OF THE INVENTION

The present invention relates to the field of automotive heat exchangers, and, in particular, to heat exchanger tanks with headers. The present invention further relates to a headering means and a method for providing improved headering means for automotive heat exchangers with plastic tanks and headers, wherein the header inner flange is removed or eliminated.

BACKGROUND OF THE INVENTION

Motor vehicles employ heat exchangers to heat or cool various elements of an automotive engine and its component parts. UK Patent application GB 2166862 A, published May 14, 1986, Gebhard Schwarz, 'Vehicle radiator' discloses a radiator constituted by flat tubes and a single water containing header with separating webs in the flat tubes which extend in prolongation of the separating wall in the water container. U.S. Pat. No. 4,023,618 issued on May 17, 1977, Kun et al, 'Heat exchanger headering arrangement,' discloses a heat exchanger assembly comprising a stacked array of thin-walled heat exchange channel elements. The headering arrangement includes a resilient gasket disposed around the perimeter of each face against the wall portion ends thereof and header tank means enclosing each face of the array and forms a fluid-tight seal between the header tank and the stacked array. U.S. Pat. No. 6,179,049 issued Jan. 30, 2001, Higgins, 'Heat exchanger with an integrated tank and head sheet,' discloses a heat exchanger having a core of a plurality of cooling tubes with a tank at each end of the core tubes. The tanks are formed with a plurality of cooling tube receiving apertures along a side portion of the tanks which receive the ends of the cooling tubes directly into the tanks and are attached to the tubes by brazing. U.S. Pat. No. 4,183,402 issued Jan. 15, 1980, Cotter, 'Heat exchanger headering arrangement,' discloses a heat assembly comprising a stacked array of heat exchange channel elements. The improved headering arrangement includes sealing members each having a bearing surface with a generally corrugated contour and header tank means joined to the sealing members so as to leak-tightly enclose the associated face of the stacked array of heat exchange channel elements. Heat exchangers employ heat exchanger tanks which typically include a coolant and require a fluid tight seal. Heat exchanger tanks may be made of a variety of materials, depending on the strength and/or temperature requirements imposed upon them in automotive applications. Plastic tanks have been utilized in heat exchangers and have proven to reduce weight while providing good thermal and strength characteristics in a number of applications. In certain commercial heat exchangers and automotive radiators, it has been common practice to employ a tube sheet headering arrangement.

In such systems, the tubes in the heater core assembly are characteristically forced through corresponding size openings in a sheet member and the latter is then joined to suitable tank or shell means to form a 'header' or header chamber communication with the tubes of the core assembly for introduction or withdrawal of fluid being passed through the tube members.

In certain state of the art designs for automotive heat exchangers with plastic tanks, headers that are stamped from an aluminum sheet are used. In such designs, tube slots are formed with 'ferrules' or 'collars' in the header to accept tubes and to provide a mating surface for brazing the tubes to the header.

As described above, such tank-header arrangements require a fluid tight seal. In order to create such a seal, a depression or trough is formed around the periphery of the header to accommodate the 'edge flange' or 'foot' of the plastic tank, which also serves to retain a header gasket that provides a seal between the tank and header. Correspondingly, the header further includes an oppositely directed 'depression' or 'pan' within the periphery of the outer trough. In certain prior art heat exchangers, the edges of the plastic tank are molded to the turned flange or foot. During construction of the heat exchanger, the tank is installed in the trough, with the tank foot compressing the gasket. The outer edges of the aluminum header are then bent or 'crimped' to capture the edge of the tank foot, thereby joining the tank to the header (See prior art FIG. 1). However, due to the strict requirements imposed upon use of such plastic tanks in automotive applications, and the need to provide fluid tight seals, designs for plastic heat exchanger tanks also use 'flanges' or 'feet' that fit inside the trough formed around the periphery of the header.

In addition, different heat exchanger applications are subjected to different internal pressure and related conditions. Radiators typically have lower operating pressures and temperatures than charge-air-coolers. Radiator tanks can generally be more compact, since the internal fluid is a higher density liquid. Charge-air-coolers, inter coolers and after coolers typically operate at higher temperatures and pressures, and with more rapid transients than radiators in the same vehicle application. Higher pressures and larger wall surface areas result in greater wall deflection in such applications. Higher temperatures reduce the stiffness and fatigue resistance of the materials. These factors contribute to greater structural integrity and durability problems with more extreme temperature and pressure conditions.

Reinforcing ribs have also been used on the header of heat exchanger Between tube slots (See FIG. 2). Recently a so-called 'all-aluminum heat exchanger has been invented that provides for brazing of the inner flange of the header to the ends of the tube as an option when utilizing plastic tanks. See U.S. Patent application 2003/0217838A1 published Nov. 27, 2003, Dey et al. Problems identified in the prior art, therefore, include that of a trough (or well) formed in the periphery of the header that tends to increase the overall thickness of the heat exchanger, which can result in packaging problems in the vehicle; and, that of a header width also creates a bending moment, as the offset of the gasket (lower) flange from the header plane generates a second bending moment.

Problems identified in the prior art, therefore, include that of a trough (or well) formed in the periphery of the header tends to increase the overall thickness of the heat exchanger, which can result in packaging problems in the vehicle; and, that of a header width also creates a bending moment, as the offset of the gasket (lower) flange from the header plane generates a second bending moment.

These bending moments contribute to stress concentrations in the header when internal pressure is applied. Moving the inner flange inward such that it contacts and is brazed to the tube improve packaging. However, the solution of connecting the inner flange to the thin-walled tube can create stress concentrations in the tube under internal pressure which may exceed acceptable limits in some applications. This, in addition to the problem of internal temperature and pressure conditions in heat exchanger applications, require further solutions not yet found in the prior art.

One response to these conditions has been to provide more rigid tanks and headers for extreme temperature and/or pressure heat exchanger applications. Tank and header deflection and corresponding stresses can lead to failure in the tank wall, in the header, or in the tube-to-header joint area.

Even in a case of radiators, in the initial vacuum coolant filling of radiators in the factory, extreme internal environmental conditions, such a low internal pressure is required that may pull the radiator tank walls and gasket inward, must be resisted by a reinforced feature such as a header inner flange, or the like.

Solutions such as a brazed flange design would achieve similar compactness, but brazing the inner flange to the tube can create stress concentrations in the tube under pressure loading.

Headering means employing mechanical attachment and sealing methods have been developed, due to the difficulty of effectively welding, brazing or soldering of unlike materials (such as alloy headers with plastics such as those found on radiator header tanks). One solution is to provide for an inner flange that encloses a gasket and tank foot, reducing the tendency of the latter to rotate under internal pressure. While this design has been found to be adequate for many radiator applications, it has many disadvantages which are accentuated, as described above, when used in more extreme, and, particularly, internal high temperature and pressure conditions, such as those found in charge air coolers and the like. The present invention has even further advantages as it relates to heat exchangers when fluid flow involves lower density liquids or where operating pressures are greater than moderate or even high to very high.

SUMMARY OF THE PRESENT INVENTION

The present invention provides for headering arrangement for a heat exchanger, and, particularly, a heat exchanger headering arrangement comprising a header part and plastic tank part that forms an adequate seal without the need for a header inner flange. Preferably, the present invention provides for a heat exchanger operating at extreme or higher operating pressures and temperatures, such as those found in charge air coolers, inter coolers, after coolers and the like, wherein the offset between the outer flange and the tube is decreased, reducing bending movements in the header caused by internal pressure loading more preferably in inner flange is utilized. Also, surprisingly, the present invention finds advantages in extreme internal lower pressure conditions, such as radiator applications.

The present invention address and solves problems of the prior art. In preferred embodiments of the present invention the headering arrangement is such that there is no header inner flange. The header inner flange is removed or eliminated. The preferred embodiments of the present invention position inside edges of a tank foot and gasket by the collar that forms the tube ferrule, the collar therefore acting as a 'rib' between header slots to stiffen the header and strengthen or protect the thin-walled tube. In further preferred embodiments, a gasket-mating surface ('gasket' or 'lower flange') is provided coplanar with the header, thus eliminating the header pan.

In preferred embodiments in accordance with the present invention, the design is very compact; only about twice the header thickness (less thinning due to forming), plus the tank foot width, extends beyond the end of the tube on each side. The preferred embodiments, therefore, comprise at least one collar-style tube ferrule acts as a rib, with a resultant 'stiffening' of the header and 'bridging' over the tube-to-header joint or seal to reduce stresses in the thin-walled tube. In preferred methods in accordance with the present invention, embodiments with more rigid headers, the more rigid header designs also have been shown to improve the crimping process.

It is an object of the present invention to provide a headering arrangement whereby there are limited obstructions or restrictions in the gorge space of the header.

It is a further object of the present invention to provide an improved headering means wherein a flat header is formed (the header inner flange is eliminated), and the outer flange, gasket, and gasket sealing surface are moved inward toward the tube. It is a further objective to utilize the collar/tube ferrule for gasket and tank foot location and for reinforcement of the header. Since the header inner flange is eliminated, the total thickness of the header is reduced accordingly. It is further an object of the present invention to provide a method of making a headering arrangement comprising, removing or eliminating the header inner flange; moving the outer flange gasket and gasket sealing surface inward toward the tube; utilizing the collar/tube ferrule for gasket and tank foot location; and, reinforcing the header, thereby minimizing the overall depth of the heat exchanger and reducing structural bending moments by moving the outer header flange inward.

In preferred embodiments of the present invention, the collar/tube ferrule acts as a reinforcing rib, bridging over the critical, i.e. 'fluid tight' tube-to-header joint or seal. In accordance with preferred embodiments of the present invention, and headering arrangement, provides for simplified and compact header designs with improved fabrication characteristics and maximally efficient use of materials, meaning, reduced cost and improved manufacturability, durability and packaging.

In more preferred embodiments, molded heat exchanger tanks are preferably utilized. In its preferred embodiments, the present invention provides for an apparatus and method for reducing induced stresses in heat exchangers, and, in particular, in heat exchanger tanks or collectors, by providing a headering assembly that reduces the width of the header and optimizes the pressure counter-force path. In more preferred embodiments of the present invention, the pressure operating limits of heat exchangers, and, in particular, pressure limits related to the headering means between the heat exchanger core part and the heat exchanger tank part, can thereby be increased while utilizing less material in the headering area.

It is also preferred to provide a sealing means between the header part and the core part of the heat exchanger to ensure that any joint or area of contact remains sealed to the maximum extent possible under the operating pressure limits of the heat exchanger (fluid tight seal). In more preferred embodiments in accordance with the present invention, the sealing means is a 'joint' or 'gasket'; the gasket preferably is used between the heat exchanger header part and heat exchanger body part at the area of contact or seal. More preferred are gaskets that can be cured to maintain their sealing effect. Even more preferred are gaskets that can be cured in place, or cured at the site or area of contact or seal. Also even more preferred are gaskets that can be utilized in both high pressure and lower pressure operating limit environments. Also even more preferred embodiments of the present invention wherein the gasket can be cured in place, and, therefore, utilized in either radiator or higher pressure heat exchanger applications, such as charge air coolers, intercoolers and after coolers, and the like.

In preferred aspects of the present invention, the collar height of the header collars are calculated to maximize correct positioning and alignment of the gasket. Surprisingly, in preferred aspects of the present invention gasket retention is maintained at a high level in both lower and higher pressure environments, such as those found in radiators, charge air coolers and the like, and during engine cooling system fill, i.e; vacuum for better filling, conditions. In the preferred embodiments of the present invention, the correct positioning of the gasket during both assembly and during cycled pressure tests is maintained.

In preferred embodiments of the present invention, the tank design provides for a robust or deflection resistant tank, thereby reducing tube fatigue and fractures, and, in particular, tube fatigue or fractures at or just below the braze joint with the header.

In preferred methods of the present invention, no inner header flange is produced, or, eventually, the inner header flange is eliminated or removed to maintain the flatness of the header during the production processes.

DETAILED DESCRIPTION OF THE PREFERRED EMBODIMENT

The present invention, in its preferred embodiments, overcomes many problems of the prior art. In preferred embodiments, the offset of the outer flange is decreased relative to the tube, thus reducing bending moments on the header due to internal pressure loads on the tank. In the preferred embodiments of the present invention, elimination the offset between the gasket sealing surface or gasket (lower) flange and the header plane eliminates a second bending moment, simplifies the header design, reduces material required, and maximizes ambient airflow to the core.

Elimination of the inner flange and utilization of the tube collar/ferrule 'collar' as a rib structure significantly stiffens the header. Linear FEA of preferred embodiments of the present invention indicates up to about a 40% reduction in stress compared to prior art designs examined. The collar also serves to prevent inward translation of the tank foot during crimping. This can improve durability and the header tab crimping process.

In more preferred embodiment of the present invention, the collar around the tube end radius is revolved and a separation maintained between the tube and the planar area of the header. The collar/rib effectively bridges over the tube, thereby reducing or preventing bending loads in the header from being transmitted to the thin-walled tube. In other preferred embodiments, and, particularly, in radiator applications, gasket retention means on the tank foot may be applied to maintain preferred gasket location and/or placement during vacuum filling.

Figure 1:
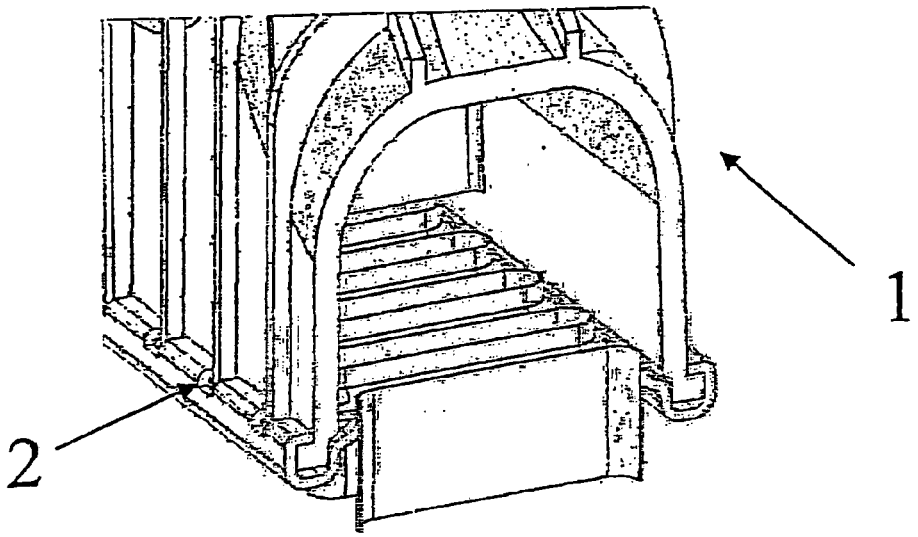
FIG. 1 Prior Art
FIG. 1. Schematic representation of Prior Art design for plastic tank heat exchanger tank and header manifold assembly.
Figure 2:
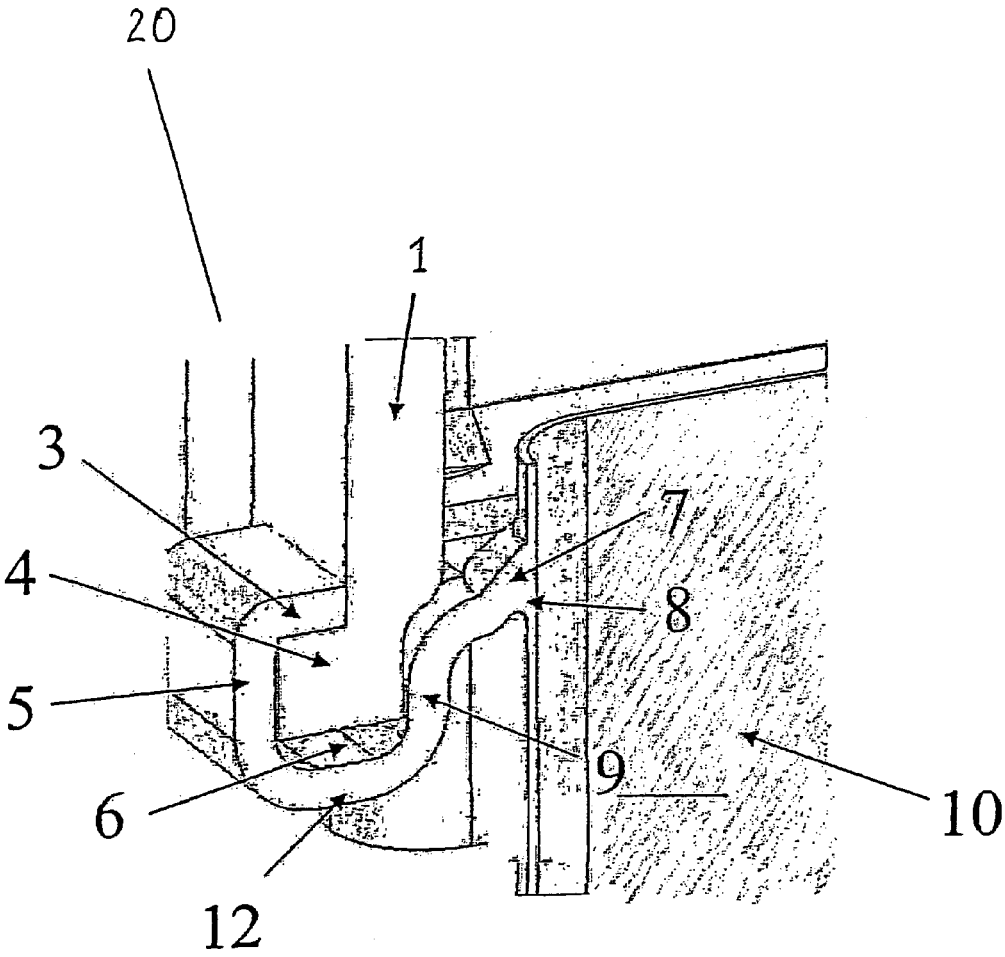
FIG. 2 Prior Art
FIG. 2. Schematic representation of Prior Art design for plastic tank heat exchanger tank and header manifold assembly.
Figures 3A, 3B, 3C:
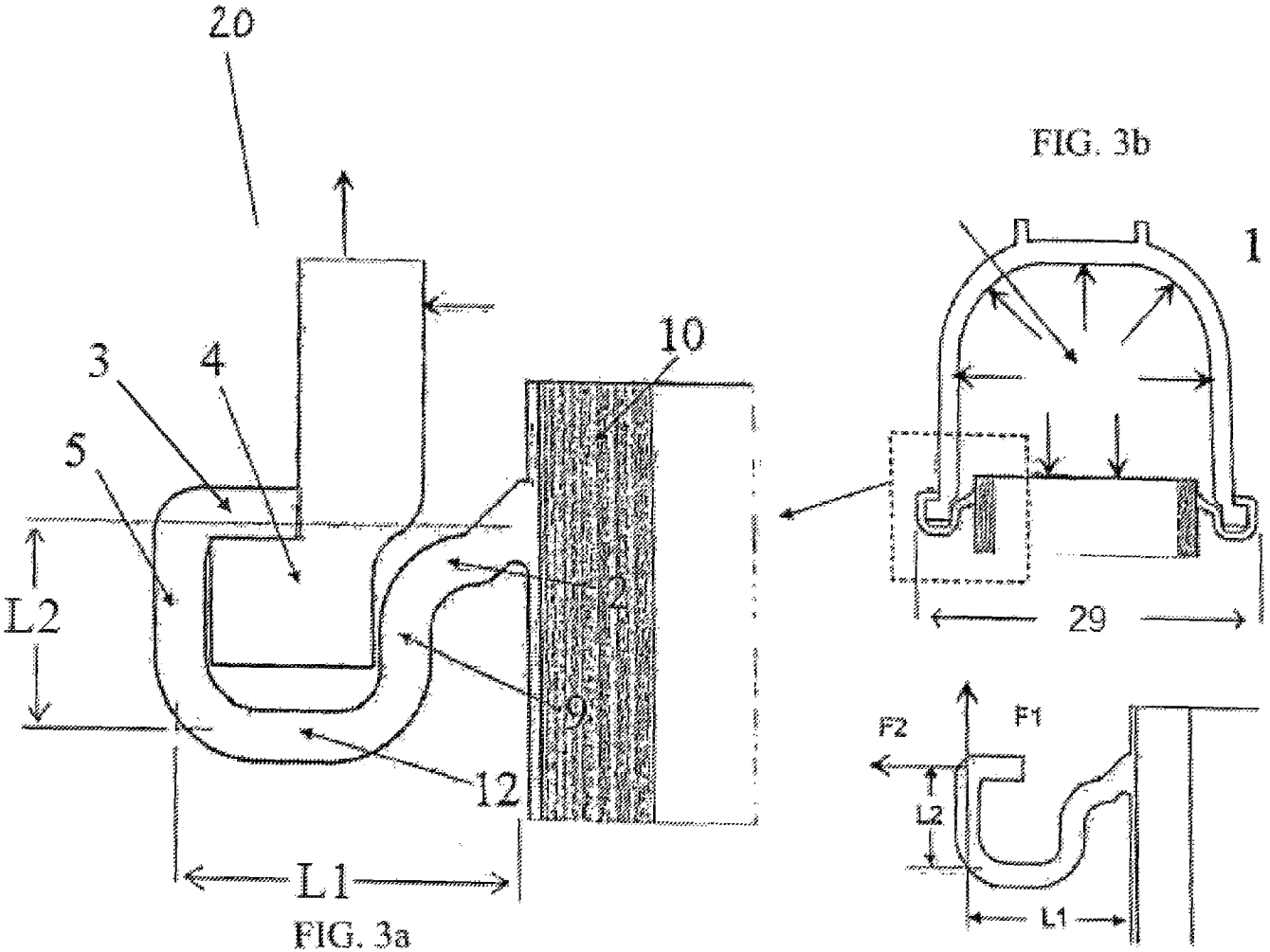
FIG. 3a Prior Art
FIGS. 3*a*, 3*b* and 3*c* showing increased overall thickness and bending moments found in prior art designs.

Referring to the prior art shown in FIGS. 1, 2 and 3, therein represented is a plastic tank 1 of a heat exchanger, with header 2. In FIG. 2, tube 10 is brazed at braze joint 8 to a shaved tube ferrule 7 which continues to an inner flange 9 and leads to lower or gasket flange 12 wherein the gasket 6 (not shown) sits. An outer flange 5 extends upwards toward a crimp tab 3 which maintains a tank foot 4 in the tank and header manifold assembly 20. FIGS. 3*a-c* show the header 2 continuing onto an inner flange 9 and into a lower flange 12, prior to turning upward into outer flange 5 before leading to the tab 3, which, in this depiction, is crimped around the tank foot 4.

Referring to prior art FIGS. 3*a, b* and *c*, the depression (trough or header well) formed in the periphery of the header tends to increase the overall thickness 29 of the tank and header manifold assembly 20 as shown in prior art FIG. 1. This representation demonstrates the resultant packaging problems for some vehicle applications. The outer header flange 5 offset creates a bending moment arm (L1) 14. A second bending moment arm (L2) 15 exists due to the offset of the gasket (lower) flange 12 from the header plane. When internal pressure is applied, resultant forces (F1, F2) act through these moment arms to generate bending loads. These loads contribute to stress concentrations in the header when internal pressure is applied. Testing, such as that based linear finite element analysis (FEA), shows stress results for preferred embodiments of the present invention that show stress level reductions up to or equal to about 40% lower compared to prior art designs such as described above.

Figure 4:
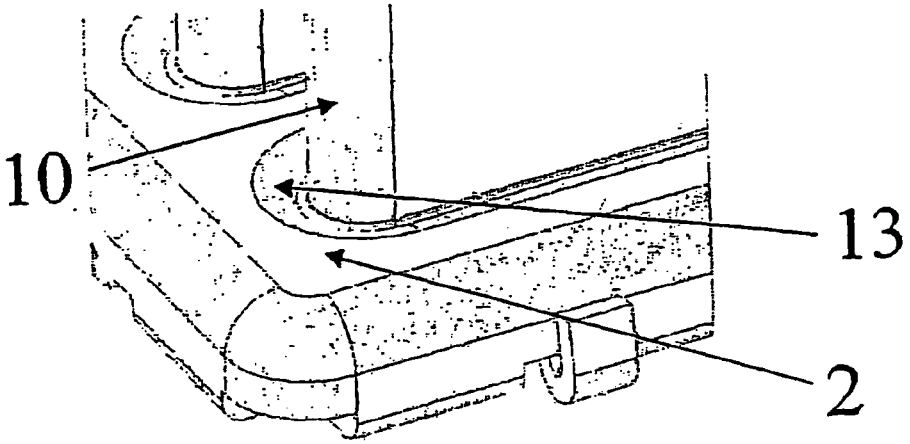
FIG. 4. Schematic elevational representation in accordance with an aspect of the present invention showing flat header where header inner flange not included and offset in gasket flange.
Figure 5:
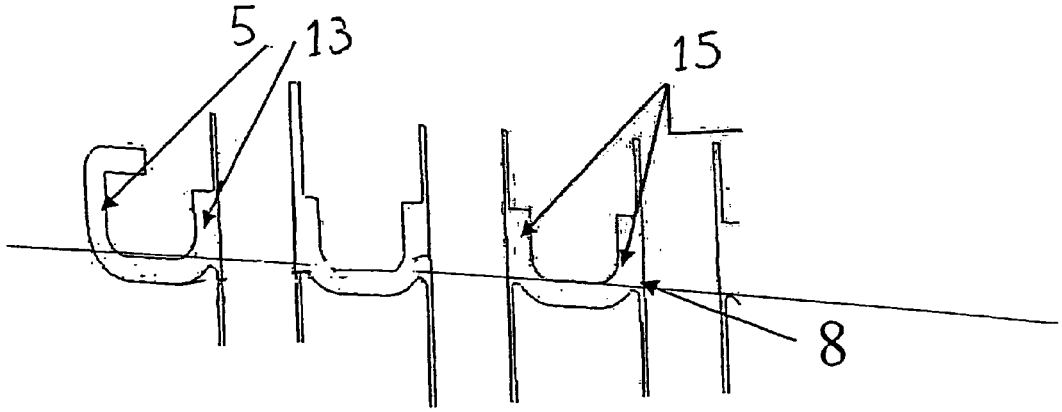
FIG. 5. Schematic cross-sectional representation of collar ribs in accordance with an aspect of the present invention.
Figure 6:
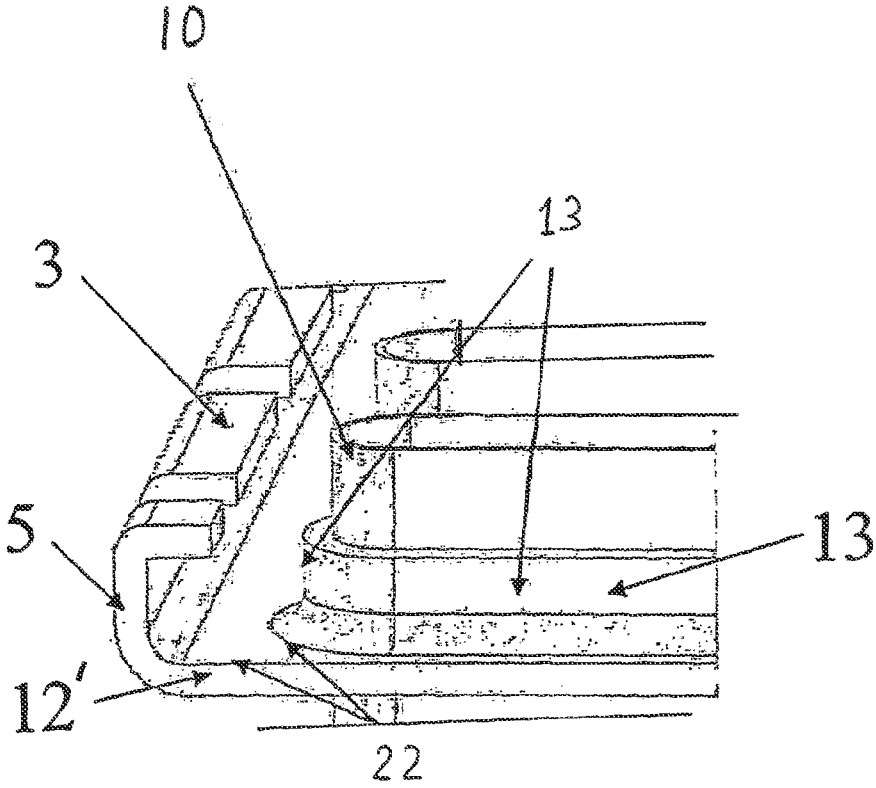
FIG. 6. Schematic representation of collar rib in accordance with an aspect of the present invention.

Referring to FIGS. 4, 5 and 6, the outer flange 5, gasket 6, and gasket-sealing header surface 22 are moved inward toward the tube 10. This tends to reduce the overall thickness of the heat exchanger for improved packaging. The offset between the outer flange 5 and the tube 10 is also decreased, which reduces bending moments in the header caused by internal pressure loading. The planar connection means that the inner flange found in the prior art is eliminated.

Referring to FIGS. 5 and 6, braze joint 8 is shown and deeply drawn upturned collars 13 form a U-shaped cross-section or rib 15 between tube slots, significantly increases the bending moment of inertia of the header section. The collar profile, which includes a large radius, is revolved around the end radius of the tube, effectively bridging over and shielding the critical tube-to-header interface. This minimizes the transmission of bending loads to the thin wall of the tube. The height of the formed collar is adjusted, as appropriate, to provide optimized height to performance ratios.

Figure 7:
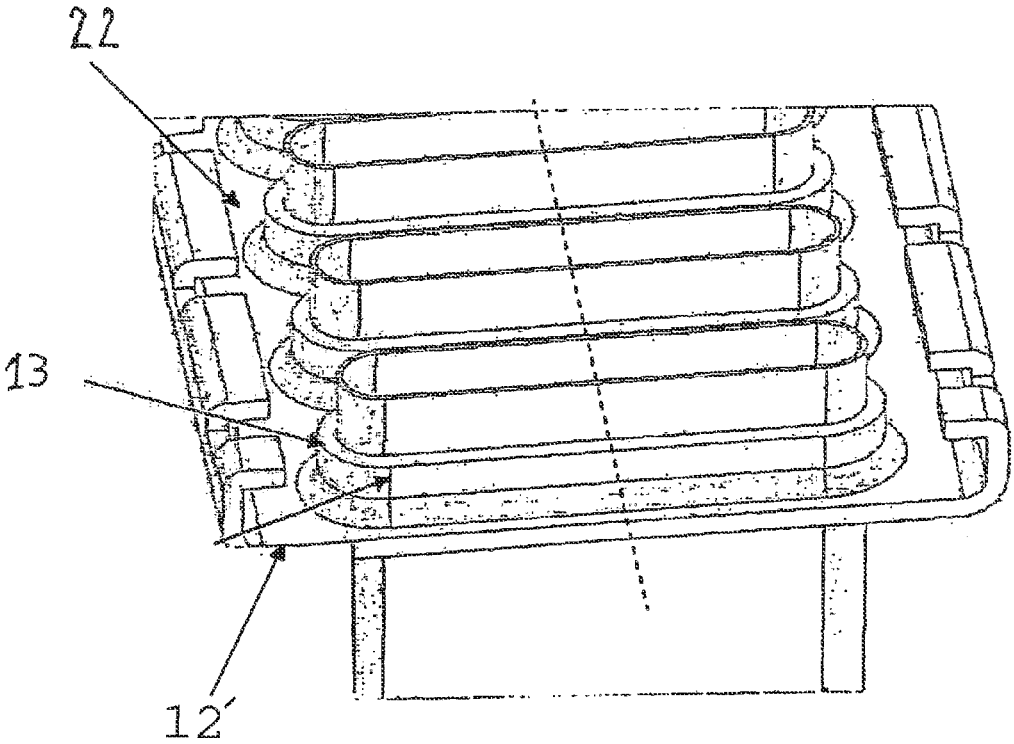
FIG. 7. Schematic elevational representation of collar rib in accordance with an aspect of the present invention shows the preferred embodiment of the invention for plastic tank automotive charge-air-cooler applications.

In preferred embodiments of the present invention applying reverse or brazed flange concepts, the elimination of the inner flange for plastic tank applications shows further advantage. Referring to FIGS. 4 and 7, the gasket (lower) flange 12' is made coplanar with the header surface 22 between the tube slots, eliminating the offset of the gasket (lower) flange relative to the header plane.

Figure 8A:
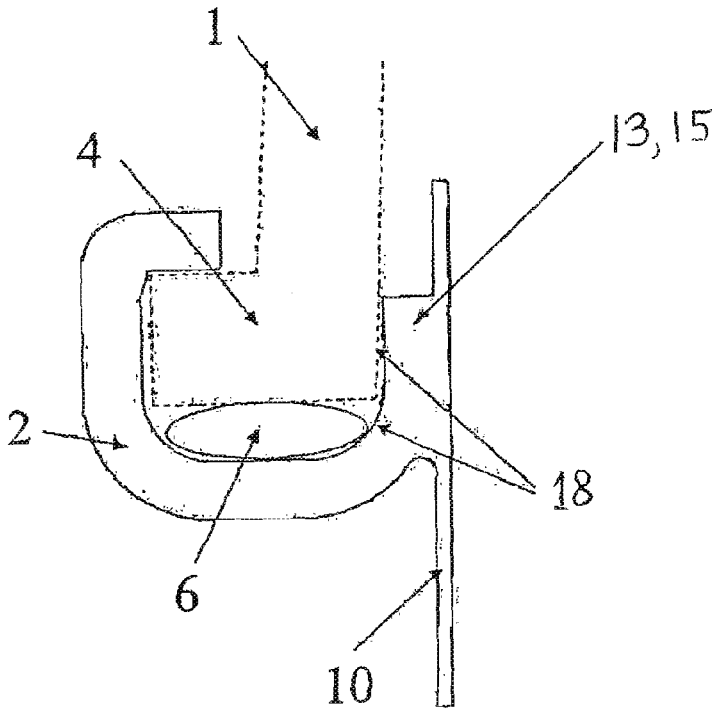
FIGS. 8*a* and 8*b* Schematic elevational representation of collar rib in accordance with an aspect of the present invention showing gasket and tank foot location.
Figure 8B:
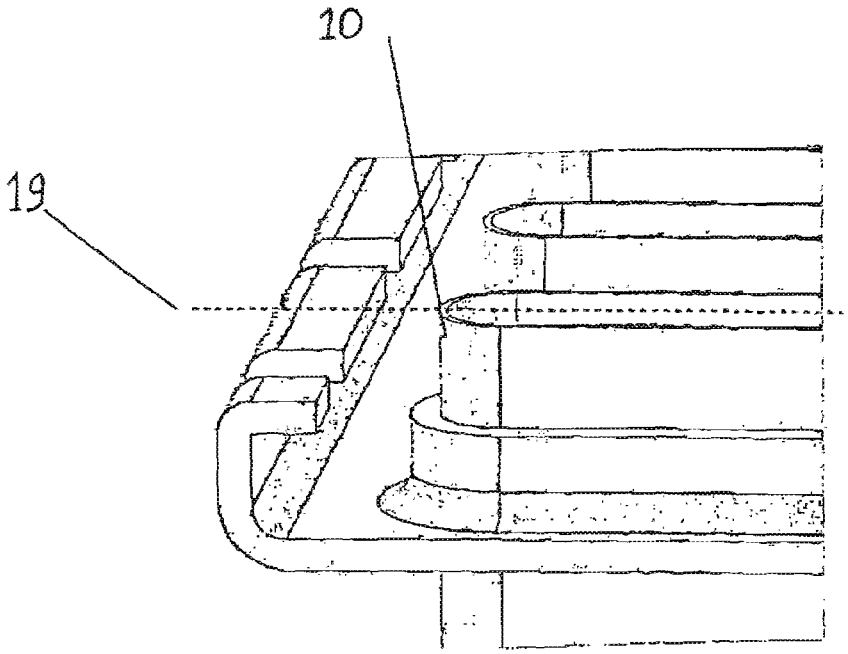

Referring to FIGS. 8*a* and 8*b*, stresses in the tube-to-header region are significantly reduced for the proposed design compared to the prior art. The collar/rib 13, 15 is relied upon for gasket 6 and tank foot 4 location and retention as well as stiffening the header 2 and providing a clad surface for brazing to the tube 10. Resistance to inward translation of the tank foot by the collar is expected during crimping, which should improve the process. Tank foot 4 and gasket 6 are retained by this collar/rib design.

In one aspect of the present invention the upturned collar of tube ferrule is cladded with braze material on the inside of the collar. By providing inside cladding, an aspect in accordance with the present invention, minimizes the possibility of magnesium diffusion from the sheared surface of the collar from contaminating the braze joint, thereby improving braze quality.

In preferred embodiments of the present invention, synthetic resin, plastic or plastic like tanks are used. More preferred are embodiments wherein the synthetic resin, plastic or plastic like materials used in the tanks are used for higher pressure environment applications, such as charge-air-cooler applications and the like. The invention can be applied to any heat exchanger with separate, mechanically assembled (rather than soldered, brazed, welded, or otherwise bonded) tank, gasket, and header components.

In preferred methods of the present invention, no inner header flange is produced, or, eventually, the inner header flange is eliminated or removed to maintain the flatness of the header during the production processes. Particularly preferred are methods employing a stamping step in the process. More particularly preferred methods also involving a brazing step. In the preferred methods of the present invention, the stamping process will employ a stamping tool designed to maintain flatness of the plane of the header, so that the plane does not become distorted due to residual stamping stress relief. In particularly preferred methods, residual stamping stress relief does not distort the plane of the header during brazing. In particularly preferred methods, a crimping step where the tabs are crimped as described above. Particularly preferred methods wherein the process uses coined or scored 'tabs' to aid in bending or provide an initiation point for bending during the crimping step.

What is claimed is:

1. A headering arrangement for a heat exchanger for use in automotive applications, comprising:

a heat exchanger body;

a plastic heat exchanger tank;

a header lying essentially in a header plane;

a tube extending from the heat exchanger body and passing through a slot provided in the header, the header defining a collar forming a tube ferrule, the tube ferrule surrounding the slot and protruding from the header plane, the header also including a crimp region;

a tank foot at the end of the heat exchanger tank; and a tank to header sealing gasket;

wherein:

a portion of the tube ferrule formed by the collar and the crimp region retain the tank to header sealing gasket and the tank foot;

the tank to header sealing gasket is essentially coplanar with the header plane;

the tube ferrule is situated at an area of passage of the tube through the header; and the crimp region is directly attached to the header.

2. The headering arrangement for the heat exchanger as defined in claim 1, wherein the collar acts as a structural feature or rib.

3. The headering arrangement for the heat exchanger as defined in claim 1, wherein the tank to header sealing gasket is essentially flat.

4. The headering arrangement for the heat exchanger as defined in claim 3, wherein the tank to header sealing gasket is cured in place.

5. The headering arrangement for the heat exchanger as defined in claim 2, wherein a collar height is proportional to a header thickness, a tube slot width and a tube pitch.

6. The headering arrangement for the heat exchanger as defined in claim 5, wherein the collar height is at least one and one half times the header thickness.

7. The headering arrangement for the heat exchanger as defined in claim 6, wherein the collar is an upturned collar.

8. The headering arrangement for the heat exchanger as defined in claim 1, wherein the heat exchanger is used in a radiator, an air cooler, an intercooler, or an after cooler.

9. A method of making a headering arrangement for a heat exchanger with a flat header, comprising the steps of:

stamping a metal sheet using a stamping tool to form a header lying essentially in a header plane, and forming therefrom a collar forming a tube ferrule, the tube ferrule surrounding a heat exchanger tube-receiving slot formed in the header and protruding from the header plane, the header also including a crimp region;

maintaining flatness of a plane of the header during the stamping step;

providing a gasket between a tank foot at the end of a plastic heat exchanger tank and a gasket flange;

providing a crimp tab to retain the tank foot between the gasket flange and an outer flange, scoring the tab at an appropriate position to allow it to retain the tank foot; and crimping the tab at the appropriate position, thereby forming the crimp region that is directly attached to the header, whereby a portion of the tube ferrule formed by the collar and the crimp region retain the gasket and the tank foot;

wherein:

the resultant headering arrangement has the gasket essentially coplanar with the header plane;

and the tube ferrule is situated at an area of passage of a heat exchanger tube through the slot provided in the header.

10. The headering arrangement as defined in claim 1 wherein the tank to header sealing gasket is essentially coplanar with the header adjacent to the slot.

11. The headering arrangement as defined in claim 1 wherein the tank is a molded tank.

12. The headering arrangement as defined in claim 1 wherein the collar substantially bridges across the tube, thereby reducing the transmission of bending stress from the header to the tube.

13. The headering arrangement as defined in claim 1 wherein the heat exchanger tank, the tank to header sealing gasket, and the header are configured to be mechanically assembled in the absence of bonding, and are configured to remain separable after assembly.

* * * * *